US006298559B1

(12) United States Patent
Kwiecien et al.

(10) Patent No.: US 6,298,559 B1
(45) Date of Patent: Oct. 9, 2001

(54) SHAVING AID STRIP FOR RAZOR CARTRIDGE

(75) Inventors: Michael J. Kwiecien, Scituate; Vincent P. Walker, Jr., Bridgewater, both of MA (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 09/737,267

(22) Filed: Dec. 14, 2000

Related U.S. Application Data

(63) Continuation-in-part of application No. 09/506,629, filed on Feb. 18, 2000, now abandoned.

(51) Int. Cl.[7] ..... B65B 21/40
(52) U.S. Cl. ..... 30/41; 30/50; 30/81; 424/73
(58) Field of Search ..... 30/34.05, 41, 77, 30/80, 81, 50; 424/73

(56) References Cited

U.S. PATENT DOCUMENTS

| | | | | |
|---|---|---|---|---|
| 4,170,821 | * | 10/1979 | Booth | 30/41 |
| 4,850,106 | * | 7/1989 | Braun et al. | 30/41 |
| 5,095,619 | * | 3/1992 | Davis et al. | 30/41 |
| 5,113,585 | * | 5/1992 | Rogers et al. | 30/41 |
| 5,345,680 | * | 9/1994 | Veerland et al. | 30/41 |
| 5,349,750 | * | 9/1994 | Tseng | 30/41 |
| 5,430,939 | * | 7/1995 | Johnston | 30/41 |
| 5,454,164 | * | 10/1995 | Yin et al. | 30/41 |
| 5,626,154 | * | 5/1997 | Rogers et al. | 30/41 |
| 5,713,131 | * | 2/1998 | Rogers et al. | 30/41 |
| 5,956,848 | * | 9/1999 | Tseng et al. | 30/41 |
| 5,956,849 | * | 9/1999 | Chadwick et al. | 30/411 |
| 6,185,822 | * | 2/2001 | Tseng et al. | 30/41 |

FOREIGN PATENT DOCUMENTS

| | | | |
|---|---|---|---|
| 2024082 | * | 1/1980 | (GB) . |
| WO-96/13360 | * | 5/1996 | (WO) . |

* cited by examiner

*Primary Examiner*—Hwei-Siu Payer
(74) *Attorney, Agent, or Firm*—Stephan P. Williams

(57) ABSTRACT

The present invention is directed to a razor cartridge with a solid polymeric shaving aid strip. The razor cartridge has a blade (one or more) and a skin-engaging portion in proximity to the blade. The skin-engaging portion includes a solid polymeric shaving aid strip having an upper exposed surface which contacts the skin during shaving. The shaving aid strip includes a first exposed lengthwise-extending portion containing a lubricious water-soluble polymer and an adjacent, second exposed lengthwise-extending portion containing a lubricious water-soluble polymer. The first portion contains a greater amount of the lubricious water-soluble polymer than the second portion, and the first portion is adapted to wear at a faster rate than the second portion during shaving. This construction enables the strip to release more of the lubricious water-soluble polymer for a longer time period (i.e., for more shaves) than conventional shaving aid strips.

17 Claims, 2 Drawing Sheets

FIG. 5
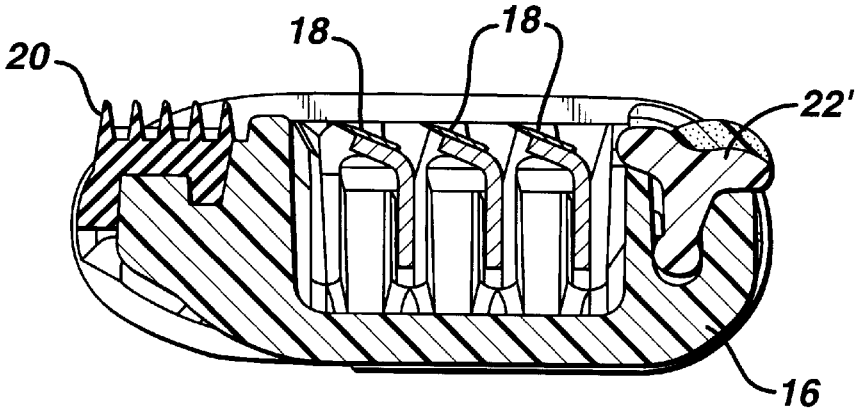
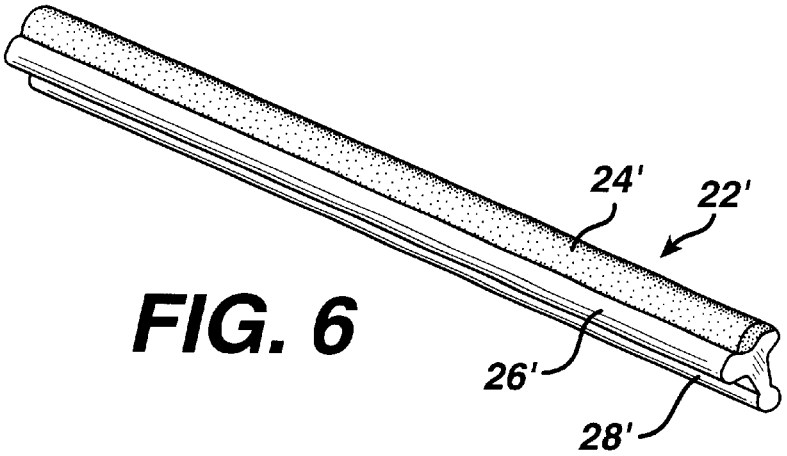
FIG. 6
FIG. 7
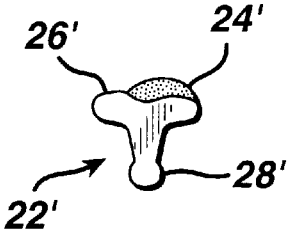

SHAVING AID STRIP FOR RAZOR CARTRIDGE

This application is a continuation-in-part of application U.S. Ser. No. 09/506,629 filed on Feb. 18, 2000 now abandoned.

BACKGROUND OF THE INVENTION

This invention relates to a shaving aid strip (or composite) for a razor cartridge.

It is now well known that shaving comfort can be enhanced by affixing to a razor cartridge a shaving aid composite, also known as a lubricating strip, which continuously releases a shaving aid, typically a lubricant, during the shaving process. See, for example, U.S. Pat. No. 4,170,821 and GB 2,024,082. The shaving aid strip generally comprises a water-insoluble polymer matrix, typically polystyrene, and a water-soluble shaving aid, typically polyethylene oxide, which leaches out of the composite during shaving to enhance shave comfort.

Unfortunately, conventional shaving aid strips suffer from the disadvantage that they release an insufficient amount of the shaving aid, particularly after the first four or five shaves where release of the shaving aid may drop off to negligible quantities. In addition, the amount of shaving aid that may be included in the shaving aid strip may be limited because high levels of shaving aid are difficult to process and can adversely affect the structural integrity of the strip. Accordingly, recent efforts have been made to improve shaving aid strips so as to enhance and prolong release of the shaving aid.

Such efforts have resulted in improved shaving aid strips which include the following features: incorporation of a low molecular weight release enhancing agent, such as polyethylene glycol, into the matrix (U.S. Pat. No. 5,113,585); the use of ethylene vinyl acetate copolymer as the matrix material (U.S. Pat. No. 5,349,750); incorporation of a compatibilizer material such as polyethylene oxide-polypropylene oxide copolymer (e.g. Poloxamer 182) (U.S. Pat. No. 5,454,164); incorporation of a water-swellable polymer such as Salsorb 84, a cross-linked polyacrylic (U.S. Pat. No. 5,626,154); coextrusion of a core comprising a water-leachable shaving aid within a sheath of water-insoluble polymer, wherein the sheath has a plurality of openings to facilitate release of the shaving aid (WO 96/13360, which corresponds to U.S. Ser. No. 08/497,194); and coextrusion of adjacent shaving aid portions (U.S. Pat. No. 5,956,848). Also known are shaving aid strips which include an essential oil (U.S. Pat. No. 5,095,619) or a non-volatile cooling agent (U.S. Pat. No. 5,713,131), and injection molded strips which include a plasticizer (U.S. Pat. No. 4,850,106). All of the aforementioned patents or published applications are incorporated herein by reference.

SUMMARY OF THE INVENTION

The present invention is directed to a razor cartridge with a solid polymeric shaving aid strip. The razor cartridge has a blade (one or more) and a skin-engaging portion in proximity to the blade. The skin-engaging portion includes a solid polymeric shaving aid strip having an upper exposed surface which contacts the skin during shaving. The shaving aid strip includes a first exposed lengthwise-extending portion containing a lubricious water-soluble polymer and an adjacent, second exposed lengthwise-extending portion containing a lubricious water-soluble polymer. The first portion contains a greater amount of the lubricious water-soluble polymer than the second portion, and the first portion is adapted to wear at a faster rate than the second portion during shaving. This construction enables the strip to release more of the lubricious water-soluble polymer for a longer time period (i.e., for more shaves) than conventional shaving aid strips.

The shaving aid strip is typically located at the rear (or cap) portion of the cartridge (i.e. behind the blade or blades), but may also be located at the front (or guard) portion of the cartridge (i.e., in front of the blade or blades), or a shaving aid strip may be placed at both positions on the cartridge. The razor cartridge is generally affixed to a handle for use in shaving. The razor cartridge may be designed to be removably affixed to a handle in the case of razor systems in which the handle is reused and the cartridge is disposed of after one or more uses. Or the razor cartridge may be permanently affixed to a handle (or integral with the handle) in the case of disposable razors in which the handle and cartridge are disposed of together as a unit after one or more uses. The term razor cartridge is thus intended to apply to both types of cartridge.

DESCRIPTION OF THE DRAWINGS

FIG. 5 is a sectional view of a razor cartridge identical to FIG. 2, but depicting a second embodiment of the shaving aid strip of the present invention.

FIG. 6 is a perspective view of the shaving aid strip depicted in FIG. 5.

FIG. 7 is a side elevation view of the shaving aid strip of FIG. 6.

DETAILED DESCRIPTION OF THE INVENTION

Figure 1:
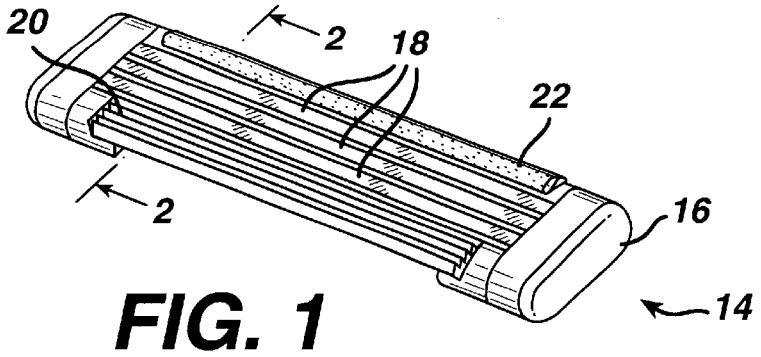
FIG. 1 is a perspective view of a razor cartridge which includes a shaving aid strip of the present invention.
Figure 2:
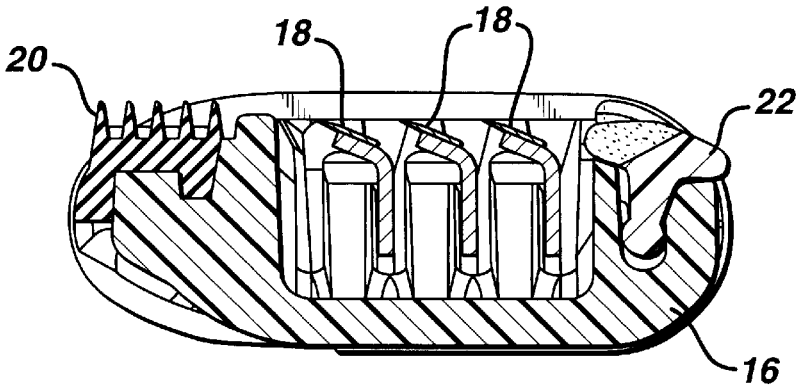
FIG. 2 is a sectional view taken along line 2—2 of FIG. 1.

Referring to FIGS. 1, 2 and 5, the razor cartridge 14 includes housing 16, which carries three blades 18, a finned elastomeric guard 20, and a solid polymeric shaving aid strip 22 (or 22') located on a skin-engaging portion (in this case the cap) of the cartridge. The shaving aid strip (or composite) is locked in an opening in the rear of the cartridge and includes a lubricious water-soluble polymer shaving aid that is released by the strip during shaving to improve shave attributes. While shown at the rear portion of this particular razor cartridge, the shaving aid strip may be located at any skin-engaging portion of the cartridge and may be fabricated in any size or shape deemed appropriate. For example, the strip can be incorporated into razor cartridges such as the Mach 3®, Sensor Excel®, Atra Plus® and Custom Plus® razors sold by The Gillette Company, as well as in other commercial razor cartridges.

Figure 3:
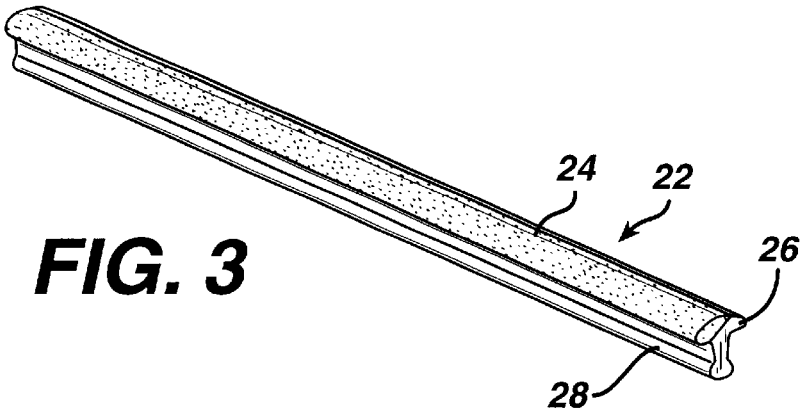
FIG. 3 is a perspective view of the shaving aid strip included in the razor cartridge depicted in FIG. 1.
Figure 4:
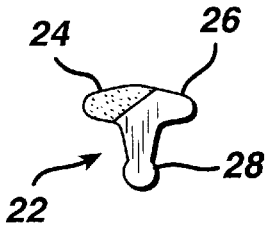
FIG. 4 is a side elevation view of the shaving aid strip of FIG. 3.

Referring to FIGS. 3 and 4, shaving aid strip 22 includes a first exposed lengthwise-extending portion 24 and an adjacent, second exposed lengthwise-extending portion 26, each portion being approximately in the shape of a rounded lobe with a lengthwise-extending exposed surface. Second portion 26 preferably extends at least partially under first portion 24 and provides support for first portion 24. The boundary between first portion 24 and second portion 26 may approximate an inclined plane as shown. Strip 22 also includes connecting portion 28, which extends below portions 24 and 26 and also optionally serves to lock the strip into a mating receiving portion of the cartridge. Second portion 26 and connecting portion 28 preferably have the same composition. The upper surface of first portion 24 preferably comprises about 55% to about 85%, more preferably about 60% to 80%, of the surface area of the upper surface of the shaving aid strip. In addition, the uppermost surface of first portion 24 preferably extends slightly above the uppermost surface of second portion 26. It is also preferred that first portion 24 comprises a greater amount (in percent by weight) of shaving aid than second portion 26. The shaving aid strip typically may be about 2.5 cm to about 3.7 cm in length, and about 0.15 cm to about 0.35 cm in width.

A second embodiment of the shaving aid strip of the present invention is depicted in FIGS. 6 and 7. In this embodiment, like the one previously described, shaving aid strip 22' includes a first exposed lengthwise-extending portion 24' and an adjacent, second exposed lengthwise-extending portion 26', each portion being approximately in the shape of a rounded lobe with a lengthwise-extending exposed surface. Second portion 26' extends substantially under first portion 24' and provides support for first portion 24'. The boundary between first portion 24' and second portion 26' is curvilinear (approximately S-shaped) as shown. Of course, the boundary may also be arcuate, either convex or concave. Strip 22' also includes connecting portion 28', which extends below portions 24' and 26' and also optionally serves to lock the strip into a mating receiving portion of the cartridge. Second portion 26' and connecting portion 28' preferably have the same composition. The upper surface of first portion 24' preferably comprises about 55% to about 85%, more preferably about 60% to 80%, of the surface area of the upper surface of the shaving aid strip. In addition, the uppermost surface of first portion 24' preferably extends slightly above the uppermost surface of second portion 26'. It is also preferred that first portion 24' comprises a greater amount (in percent by weight) of shaving aid than second portion 26'. The shaving aid strip typically may be about 2.5 cm to about 3.7 cm in length, and about 0.15 cm to about 0.35 cm in width.

A shaving aid strip constructed as described above may be inserted into a razor cartridge with first portion 24 (or 24') facing forward (i.e., in the direction of shaving) as shown in FIG. 2. Alternatively, the strip may be inserted with first portion 24 (or 24') facing rearward as shown in FIG. 5. Since first portion 24 (or 24') contains a greater proportion of shaving aid than the rest of the strip, and optionally contains other ingredients that may contribute to its faster wear characteristics, it will tend to wear away slightly faster than second portion 26 (or 26'). This faster wear tends to present a fresh surface of shaving aid, which is present in high proportion in that portion, and thus provides more lubrication over a longer period of time. At the same time, portion 26 (or 26') wears more slowly and maintains the proper shaving geometry.

Each portion of the shaving aid strip will include a lubricious water-soluble polymer as the main shaving aid and, optionally, a water-insoluble polymer to serve as a matrix in which the water-soluble polymer is dispersed. Preferably, the first portion will comprise about 0% to about 30%, more preferably about 10% to about 25%, by weight water-insoluble polymer, and about 65% to about 95%, more preferably about 65% to about 90%, lubricious water-soluble polymer. The second portion will preferably comprise about 10% to about 40%, more preferably about 20% to about 35%, water-insoluble polymer, and about 50% to about 80%, more preferably about 55% to about 75%, lubricious water-soluble polymer.

Typical lubricious water-soluble polymers include polyethylene oxide, polyvinyl pyrrolidone, polyacrylamide, modified hydroxyalkyl cellulose, polyvinyl imidazoline, polyvinyl alcohol, polysulfone and polyhydroxyethylmethacrylate. The preferred lubricious water-soluble polymer is polyethylene oxide. The more preferred polyethylene oxides generally are known as POLYOX (available from Union Carbide Corporation) or ALKOX (available from Meisei Chemical Works, Kyoto, Japan). These polyethylene oxides will preferably have molecular weights of about 100,000 to 8 million daltons, most preferably about 300,000 to 5 million daltons. It is preferred to use a blend of polyethylene oxides, typically a blend having at least one polyethylene oxide having a molecular weight in the range of 100,000 to 500,000 and at least one polyethylene oxide having a molecular weight in the range of 3 million to 8 million. The most preferred polyethylene oxide comprises a blend of about 40% to 80% by weight of polyethylene oxide having an average molecular weight of about 5 million (e.g. POLYOX COAGULANT) and about 60% to 20% of polyethylene oxide having an average molecular weight of about 300,000 (e.g. POLYOX WSR-N-750). A 60:40 blend of these two polyethylene oxides (5 million: 300,000) is especially preferred.

Suitable water-insoluble polymers which can be used include polyethylene, polypropylene, polystyrene, butadiene-styrene copolymer (e.g. medium and high impact polystyrene), polyacetal, acrylonitrile-butadiene-styrene copolymer, ethylene vinyl acetate copolymer, polyurethane and blends thereof such as polypropylene/polystyrene blend or polystyrene/impact polystyrene blend. The more preferred water-insoluble polymer is polystyrene, preferably a general purpose polystyrene, such as NOVA C2345A, or a high impact polystyrene (i.e. polystyrene-butadiene), such as BASF 495F KG21. The strip or any portion should contain a sufficient quantity of water-insoluble polymer to provide adequate mechanical strength, both during production and use.

The first portion of the shaving aid strip will also preferably include a material which allows it to wear more quickly than the second portion and/or which facilitates the inclusion of relatively high levels of water-soluble polymer. One such material is polycaprolactone, as described in copending application U.S. Ser. No. 09/506,628 (Docket No. 8070) filed on Feb. 18, 2000. Preferably, the polycaprolactone will be included in an amount of about 1% to about 10% by weight. Polycaprolactones are available from Union Carbide Corporation under the name TONE® polymers (e.g., P-737, P-767, P-787, and polyol 1270). Preferably, the polycaprolactonewill have a molecular weight between about 1000 and about 80,000 daltons, more preferably between about 30,000 and 60,000 daltons, and most preferably about 50,000 daltons.

The shaving aid strip, or any portion, also may contain other conventional shaving aid ingredients, such as low molecular weight water-soluble release enhancing agents such as polyethylene glycol (MW<10,000, e.g., 1–10% by weight PEG-100), water-swellable release enhancing agents such as cross-linked polyacrylics (e.g., 2–7% by weight), colorants, antioxidants, preservatives, botanical oils, vitamin E, aloe, cooling agents, essential oils, beard softeners, astringents, medicinal agents, etc. Portions that contain a colorant can be designed to release the colorant (e.g., by leaching or abrasion), and thereby cause the strip to change color during shaving. A portion may contain, for example, between about 0.1% and about 5.0% (preferably between about 0.5% and 3%) colorant by weight. Preferably, the first portion contains a colorant so as to contrast with the second portion, whereby wear of the first portion during shaving provides a visual indication to the user that the shaving aid strip and/or the razor cartridge has reached the end of its effective life or the end of its optimum performance.

Shaving aid strips of the present invention may be fabricated by any appropriate method, including injection molding and extrusion, the latter being preferred. All of the components of the strip are blended prior to molding or extrusion. For best results, it is preferred that the components are dry.

The blended components may be extruded through a Haake System 90, ¾ inch diameter extruder with a barrel pressure of about 1000–2000 psi, a rotor speed of about 10 to 50 rpm, and a temperature of about 150°–185° C. and a die temperature of about 170°–185° C. Alternatively, a 1¼ inch single screw extruder may be employed with a processing temperature of 175°–200° C., preferably 185°–190° C., a screw speed of 20 to 50 rpm, preferably 25 to 35 rpm, and an extrusion pressure of 1800 to 5000 psi, preferably 2000 to 3500 psi. The extruded strip is air cooled to about 25° C. To injection mold the strips it is preferred to first extrude the powder blend into pellets. This can be done on a 1¼ or 1½ inch single screw extruder at a temperature of 120°–180° C., preferably 140°–150° C., with a screw speed of 20 to 100 rpm, preferably 45 to 70 rpm. The pellets are then molded in either a single material molding or multi-material molding machine, which may be single cavity or multi-cavity, optionally equipped with a hotrunner system. The process temperature can be from 165° to 250° C., preferably from 180° to 225° C. The injection pressure should be sufficient to fill the part completely without flashing. Depending on the cavity size, configuration and quantity, the injection pressure can range from 300 to 2500 psi. The cycle time is dependent on the same parameters and can range from 3 to 30 seconds, with the optimum generally being about 6 to 15 seconds.

The invention may be further described by the following examples in which all parts and percentages are by weight.

EXAMPLES 1 to 4

Shaving aid strips with a cross-section like that of strip 22 shown in FIG. 4 are fabricated from the blends of components indicated below by coextruding the blends in the following manner. The components for each portion (portion 24 and portion 26, 28) may be supplied by two separate melting/pumping (plastics extruders), each consisting of a heated barrel, a pumping screw, a motor drive for that screw and a control system for the entire system. The materials are fed in powder form into their respective extruders (e.g., single screw type manufactured by Davis Standard). The extruders can operate at the same or different speeds and the same or different temperatures. The barrel temperature for each extruder can be ramped in three zones from 165° C. to 190° C.; a fourth heater at the die/barrel connection can also be set to 190° C., and a fifth heater at the die can range from 190° C. to 205° C. Via rugged weldments the molten streams of the components are brought together to form the strip. Portion 24 can be precisely located on portion 26, 28 through accurately machined pathways in the die head. Because they have different compositions, the two molten materials are brought together at the last possible moment before exiting the die. Both materials exit the die head in a size and shape approximating that of the final product. The final dimensions are achieved using a series of forming rollers as the extrudate is cooled. The strip is typically extruded at a rate of about 50 feet per minute. The combined molten materials are drawn from the die head into the sizing/cooling device at a constant speed such that its cross section is always constant. Under a bath of cool dry air the molten material is cooled until no longer pliable. Once cooled, the strips can be cut to the appropriate length and attached to razor cartridges like cartridge 14.

| | Weight Percent | | | | | | | |
|---|---|---|---|---|---|---|---|---|
| | Example 1 | | Example 2 | | Example 3 | | Example 4 | |
| Component | Portion 26, 28 | Portion 24 | Portion 26, 28 | Portion 24 | Portion 26, 28 | Portion 24 | Portion 26, 28 | Portion 24 |
| Polyethylene oxide[1] | 60.0 | 75.0 | 60.0 | 70.0 | 58.0 | 77.0 | 60.0 | 80.0 |
| Polystyrene[2] | | 10.2 | | 15.2 | | 14.0 | | 8.2 |
| H. I. Polystyrene[3] | 32.5 | | 32.5 | | 35.5 | | 33.5 | |
| PEG-100 | 5.0 | 5.0 | 5.0 | 5.0 | 5.0 | 5.0 | 5.0 | |
| White Color[4]/Preserv. | 1.5 | | 1.5 | | 1.5 | | 1.5 | |
| Blue Color[4]/Preserv. | | 4.0 | | 4.0 | | 4.0 | | 4.0 |
| Vitamin E | | 0.8 | | 0.8 | | | | 0.8 |
| Polycaprolactone[5] | 1.0 | 5.0 | 1.0 | 5.0 | | | | 7.0 |

[1]60:40 blend of Coagulant:WSR-N-750 (mol. wt. 5 million:300,000)
[2]NOVA C2345A
[3]BASF 495F KG21
[4]Color concentrate contains 65–95% polystyrene
[5]Tone ® P-767, P-737, polyol 1270, or P-787 (Union Carbide)

EXAMPLES 5 and 6

Shaving aid strips with a cross-section like that of strip 22' shown in FIG. 7 are fabricated from the blends of components indicated below by coextruding the blends in the manner described above with respect to Examples 1 to 4.

Once cooled, the strips are cut to the appropriate length and attached to razor cartridges like cartridge 14.

| | Weight Percent | | | |
|---|---|---|---|---|
| | Example 5 | | Example 6 | |
| Component | Portion 26', 28' | Portion 24" | Portion 26', 28' | Portion 24' |
| Polyethylene oxide[1] | 63.0 | 69.0 | 63.0 | 74.0 |
| Polystyrene[2] | | 16.0 | | 11.0 |
| H. I. Polystyrene[3] | 30.5 | | 30.5 | |
| PEG-100 | 5.0 | 5.0 | 5.0 | 5.0 |
| White Color[4]/ Preserv. | 1.5 | | 1.5 | |
| Blue Color[4]/ Preserv. | | 4.2 | | 4.2 |
| Vitamin E | | 0.8 | | 0.8 |
| Polycapro-lactone[5] | | 5.0 | | 5.0 |

[1]60:40 blend of Coagulant:WSR-N-750 (mol. wt. 5 million:300,000)
[2]NOVA C2345A
[3]BASF 495F KG21
[4]Color concentrate contains 65–95% polystyrene
[5]Tone ® P-767 (Union Carbide)

While particular embodiments of the invention have been shown and described for illustrative purposes, it will be apparent to those skilled in the art that various changes and modifications may be made without departing from the spirit and scope of the invention, which is defined by the claims which follow.

What is claimed is:

1. A razor cartridge comprising a blade and a skin-engaging portion in proximity to said blade, said skin-engaging portion including a solid polymeric shaving aid strip having an upper exposed surface, said shaving aid strip comprising, prior to first use of said cartridge, a first exposed lengthwise-extending portion containing a lubricious water-soluble polymer and an adjacent, second exposed lengthwise-extending portion containing a lubricious water-soluble polymer, wherein said first portion comprises a greater amount of said lubricious water-soluble polymer, in percent by weight, than said second portion, and wherein said first portion is adapted to wear at a faster rate than said second portion during shaving.

2. The razor cartridge of claim 1 wherein said first portion comprises about 0% to about 30% by weight water-insoluble polymer and about 65% to about 95% water-soluble polymer, and said second portion comprises about 10% to about 40% water-insoluble polymer and about 50% to about 80% water-soluble polymer.

3. The razor cartridge of claim 1 wherein said first portion comprises about 10% to about 25% by weight water-insoluble polymer and about 65% to about 90% polyethylene oxide, and said second portion comprises about 20% to about 35% water-insoluble polymer and about 55% to about 75% polyethylene oxide.

4. The razor cartridge of claim 3 wherein said polyethylene oxide comprises a blend of at least one polyethylene oxide having a molecular weight in the range of 100,000 to 500,000 and at least one polyethylene oxide having a molecular weight in the range of 3 million to 8 million.

5. The razor cartridge of claim 4 wherein said water-insoluble polymer comprises polyethylene, polypropylene, polystyrene, butadiene-styrene copolymer, polyacetal, acrylonitrile-butadiene-styrene copolymer, ethylene vinyl acetate copolymer, polyurethane and blends thereof.

6. The razor cartridge of claim 1 or 5 wherein said first portion has an upper exposed surface that comprises about 55% to about 85% of the surface area of the upper exposed surface of the shaving aid strip.

7. The razor cartridge of claim 6 wherein said first portion has an upper exposed surface that comprises about 60% to about 80% of the surface area of the upper exposed surface of the shaving aid strip.

8. The razor cartridge of claim 6 wherein said second portion extends at least partially under said first portion and provides support therefor.

9. The razor cartridge of claim 8 wherein the boundary between said second portion and said first portion approximates an inclined plane.

10. The razor cartridge of claim 6 wherein said second portion extends substantially under said first portion and provides support therefor.

11. The razor cartridge of claim 10 wherein the boundary between said second portion and said first portion is curvilinear or arcuate.

12. The razor cartridge of claim 6 wherein the uppermost surface of said first portion extends slightly above the uppermost surface of said second portion.

13. The razor cartridge of claim 11 wherein the uppermost surface of said first portion extends slightly above the uppermost surface of said second portion.

14. The razor cartridge of claim 6 wherein said first portion contains a colorant so as to contrast with said second portion.

15. The razor cartridge of claim 14 wherein said shaving aid strip is oriented on said razor cartridge such that said first portion is rearward of said second portion.

16. The razor cartridge of claim 6 wherein said shaving aid strip also includes a connecting portion which extends below said first and second portions.

17. The razor cartridge of claim 16 wherein said connecting portion has the same composition as said second portion.

* * * * *